US005159789A

United States Patent [19]

Haapanen

[11] Patent Number: 5,159,789

[45] Date of Patent: Nov. 3, 1992

[54] NOISE BAFFLE FOR DRAIN PIPES

[76] Inventor: Randy M. Haapanen, 9305 Lott Rd., Durham, Calif. 95938

[21] Appl. No.: 523,019

[22] Filed: May 14, 1990

[51] Int. Cl.[5] ..... E04D 13/08

[52] U.S. Cl. ..... 52/16; 52/12

[58] Field of Search ..... 52/11, 12, 16, 15, 14, 52/13

[56] References Cited

U.S. PATENT DOCUMENTS

| | | | |
|---|---|---|---|
| 4,608,786 | 9/1986 | Beam | 52/12 |
| 4,798,028 | 1/1989 | Pinion | 52/16 |
| 4,801,377 | 1/1989 | Bolt | 52/16 |
| 4,862,651 | 9/1989 | Walker | 52/16 |

FOREIGN PATENT DOCUMENTS

| | | | |
|---|---|---|---|
| 2055148 | 5/1971 | Fed. Rep. of Germany | 52/16 |
| 3527233 | 1/1987 | Fed. Rep. of Germany | 52/16 |

*Primary Examiner*—David A. Scherbel
*Assistant Examiner*—Michele A. Van Patten
*Attorney, Agent, or Firm*—Haverstock, Medlen & Carroll

[57] ABSTRACT

A noise baffle for reducing noise in rain gutter systems is provided. A screen or other perforated or fibrous surface is secured beneath a vertical downspout section and above the surface of an angled downspout section for reducing the noise caused by water striking the surface of angled downspouts. The screen eliminates or substantially reduces the noise by breaking the fall of the water falling in the vertical downspout section and dispersing the stream into tiny droplets which do not strike the bottom of the angled downspout section with sufficient force to create noise.

21 Claims, 4 Drawing Sheets

NOISE BAFFLE FOR DRAIN PIPES

FIELD OF THE INVENTION

The present invention relates to gutter-type drainage systems. More particularly, this invention relates to the reduction of noise caused by water flow through a gutter system.

DISCUSSION OF THE PRIOR ART

The use of rain gutters and downspouts to collect and divert water is well known. A main trough or gutter is usually attached to the edge of a sloped or angled roof such that rain water runs off the roof and into the gutter. At various places, the gutter has openings to which downspouts are attached in order to carry the collected water down towards the ground. Often, the downspouts include both vertical and angled (or horizontal) sections which serve to divert the water away from the building and into either another downspout section, or the ground or a drain.

Inherent in the use of such gutter systems is the creation of noise by the flow of the water through the system. In particular, significant noise is created as water falling through a vertical downspout section in a gutter system strikes the bottom surface inside an angled downspout section located beneath (downstream of) the vertical downspout section. Such noise can be annoying.

Thus, the need exists for an apparatus for eliminating or substantially reducing the noise created when water or other liquid falls through a vertical downspout section and strikes the bottom surface inside an angled downspout section.

SUMMARY OF THE INVENTION

It is an object of the present invention to provide a method and apparatus for baffling the sound of water hitting angled or horizontal surfaces in the downspout portion of a rain gutter system. Such an object may be achieved by inserting a noise baffling device having a perforated or fibrous surface between a vertical downspout section and the bottom surface of a downstream angled downspout section. A better understanding of the invention and its advantages will be apparent from the detailed description taken in conjunction with the accompanying drawings.

DETAILED DESCRIPTION OF THE INVENTION

Figure 1:
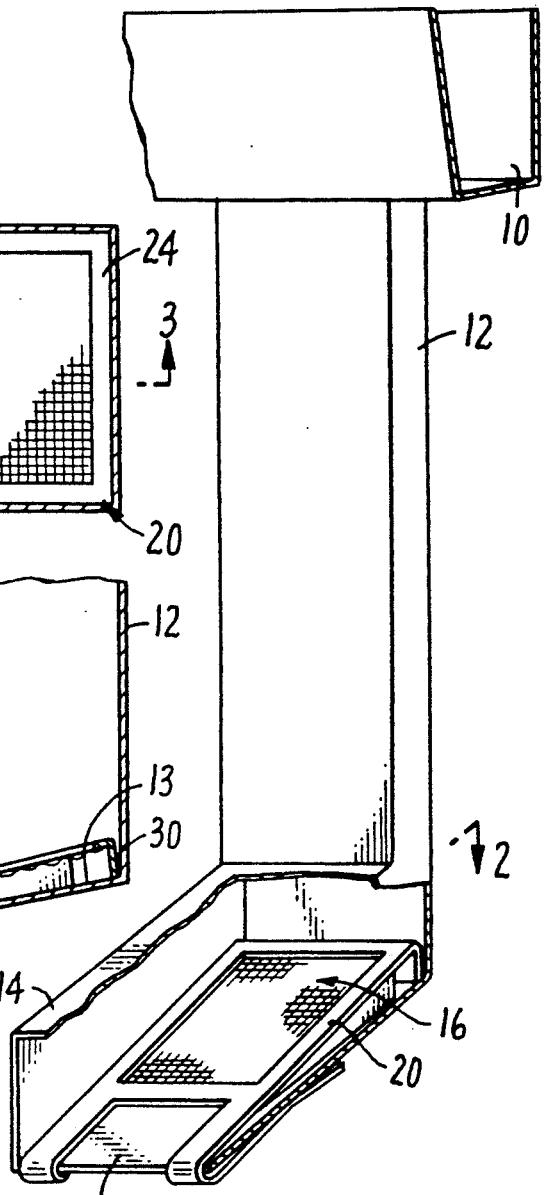
FIG. 1 is perspective view of a typical gutter system including a downspout, having a vertical downspout section attached to an angled downspout section, which is cutaway to show a noise baffle of the present invention.
Figure 5:
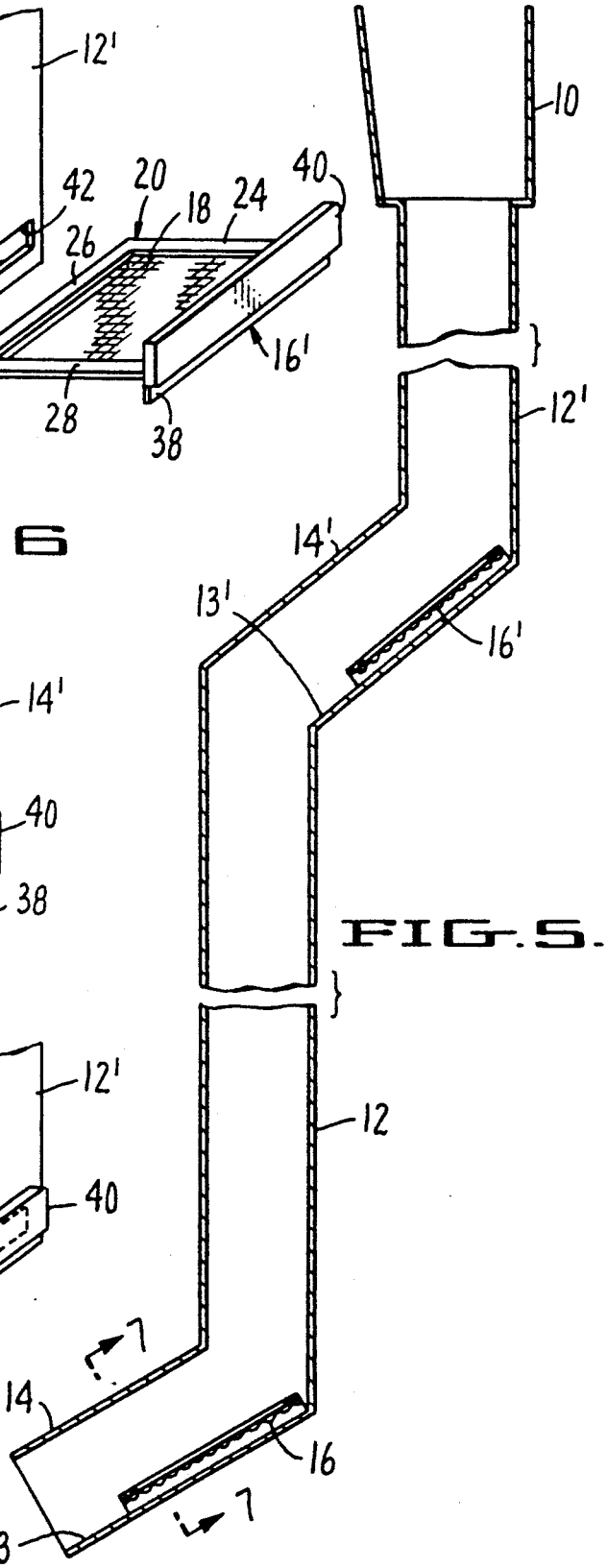
FIG. 5 is a sectional side view of a typical gutterway system showing the placement of noise baffles of the present invention.

A typical gutter and downspout system is shown in FIGS. 1 and 5. Water is collected in main gutter 10, where it flows down through a vertical downspout section 12, into an angled downspout section 14 and so on downstream until the water is directed to the ground or into a drain or sewer. The angled downspout section 14 contains the noise baffle 16 of the present invention. Because noise is created when the fall of the water is broken by striking the bottom surface 13 of the angled downspout section 14, it will be appreciated that "angled section" can include downspout sections which are less than vertical as well as downspout sections which are horizontal or nearly so and every position in between. That is, the angle formed between the vertical downspout section and the angled downspout section can vary from about 90 degrees to less than about 180 degrees.

Referring to FIGS. 1-4, the noise baffle 16 consists of a perforated or fibrous plate or surface 18 contained within frame 20, said frame being defined by first edge 22, second edge 24, third edge 26, and fourth edge 28. Preferably, the perforated plate 18 is a mesh fabric, like the woven wire or plastic screen fabric used in typical residential window screens, tautly attached to frame 20. Perforated plate 18 preferably has a mesh size of about 120 to about 260. The perforated plate can also be constructed from relatively thin, perforated metal, plastic, cloth fabric or other suitable material. Alternatively, the plate 18 can be constructed from a non-absorbent, rough, fibrous material of sufficient density and thickness to break the fall of a downflowing stream of water. Such materials include, for example, Velcro ® or 3M's Scotchbrite ®. A thickness of about 0.2 inches of Scotchbrite ® has been found to be sufficient, however, a greater thickness may be used.

One or more of the edges of frame 20 may be eliminated if the material from which the perforated or fibrous plate is constructed is stiff and inflexible or is sufficiently thick so that the top of the perforated or fibrous plate 18 can be maintained above the bottom surface 13 of an angled downspout section.

Figure 4:
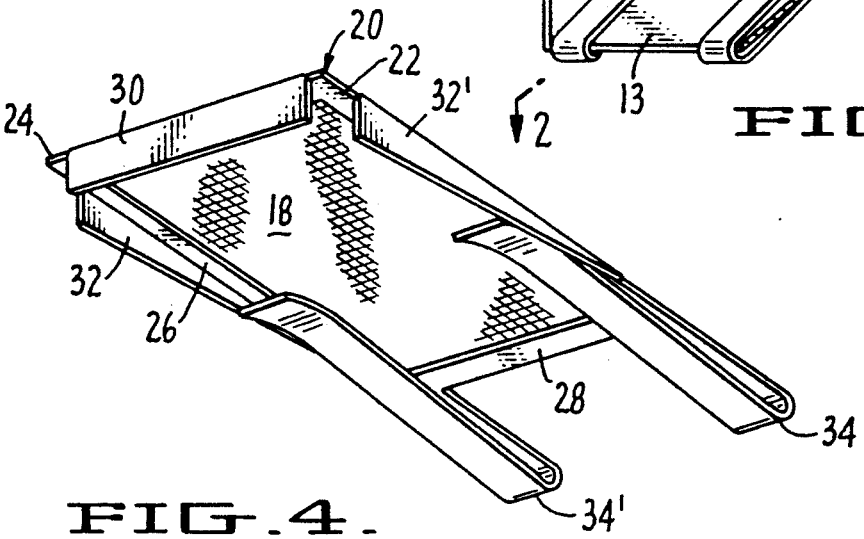
FIG. 4 is a perspective view of the bottom of the noise baffle shown in FIGS. 1-3.

As shown in FIG. 4, attached to the bottom of the noise baffle 16 is a fixed width spacer 30 and a pair of graduated spacers 32 and 32'. The fixed width spacer 30 is attached to edge 24, and is of sufficient size to hold the top surface of the noise baffle 16 above the plane of bottom surface 13 of angled downspout section 14 at a distance of preferably about one-half inch. The graduated spacers 32, 32' are attached to the longer edges 22 and 26 respectively and are adapted to hold noise baffle 16 at a slight angle to the bottom surface 13 of angled downspout section 14.

Figure 2:
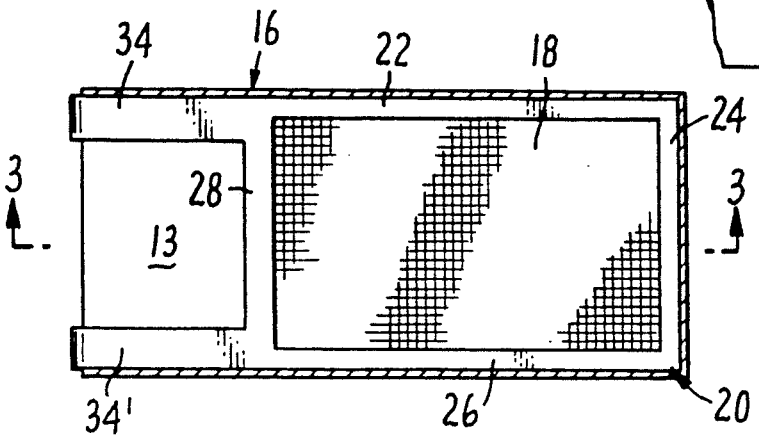
FIG. 2 is a top plan view of the installed noise baffle taken through line 2—2 in FIG. 1.
Figure 3:
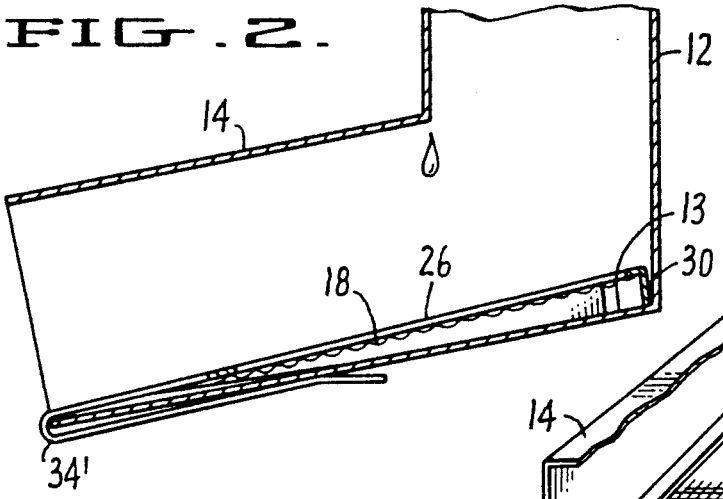
FIG. 3 is a sectional view of the installed noise baffle taken through line 3—3 of FIG. 2.

Attached to the shorter fourth edge 28 of frame 20 and extending from each of the longer edges 22 and 26 of frame 20 are a pair of clips 34 and 34' for removably attaching noise baffle 16 to the bottom surface 13 of angled downspout section 14. Said clips extend out from the top surface of the noise baffle 16 and then bend over and back toward the bottom surface of the noise baffle 16 as shown in FIGS. 3 and 4. Clips 34, 34' are constructed from spring steel or any other material capable of exerting a tension upon edges 22 and 26 of the noise baffle 16, such that the noise baffle will be held in place on any surface interposed between the clips 34, 34' and the edges 22 and 26. Further, the use of such clips allows the noise baffle to be easily removed for cleaning to prevent the accumulation of debris on or around the noise baffle in order to permit optimal operation of the gutter system.

Thus, when water flows from the gutter 10 into the downspout and falls through vertical downspout section 12 and onto the top surface of noise baffle 16 before striking the bottom surface 13 of angled downspout section 14, the noise baffle 16 is effective in reducing or eliminating the loud metallic ringing and other noise caused by the water striking the bottom 13 of the angled downspout section 14. The perforated or fibrous plate 18 of the present invention breaks the fall of the downflowing water stream a short distance above the surface 13 of the angled downspout section 14, breaking the water into very tiny droplets, thus dispersing and deflecting the water so it will contact the bottom of the angled downspout section more evenly and with less concentrated force, substantially reducing or eliminating the loud metallic and other noises otherwise created by the falling water. The baffle shown in FIGS. 1–4 is particularly useful in a terminal angled downspout section 14, where it can be easily installed or removed by sliding into the open end of the angled downspout 14 with the clips 34, 34' resting against the outer portion of the bottom surface 13 of angled downspout 14.

FIGS. 5–8 illustrate another noise baffle of the present invention. This embodiment is particularly useful for reducing or eliminating noise generated in intermediate angled downspout sections 14' as shown in FIG. 5. In the system of FIG. 5, main gutter 10 is connected to a vertical downspout section 12', followed by an intermediate angled downspout section 14', and so on ultimately followed by a final vertical downspout section 12, attached to a terminal angled section 14 from which the water flows out of the gutter system.

Figure 6:
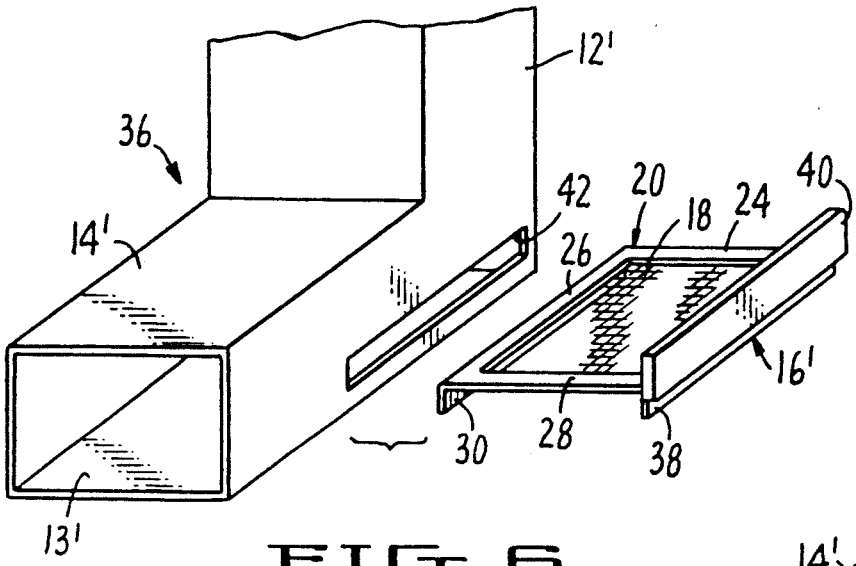
FIG. 6 is an exploded view of a typical junction between a vertical downspout section and an angled downspout section showing the placement of a noise baffle of the present invention.
Figure 7:
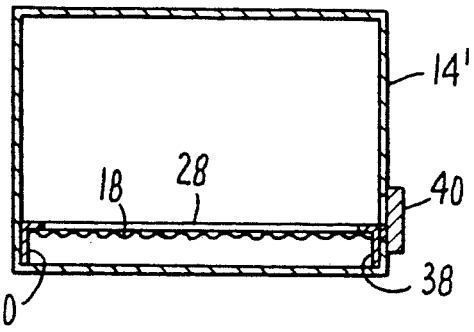
FIG. 7 is a sectional side view of the noise baffle of FIG. 6 after installation.
Figure 8:
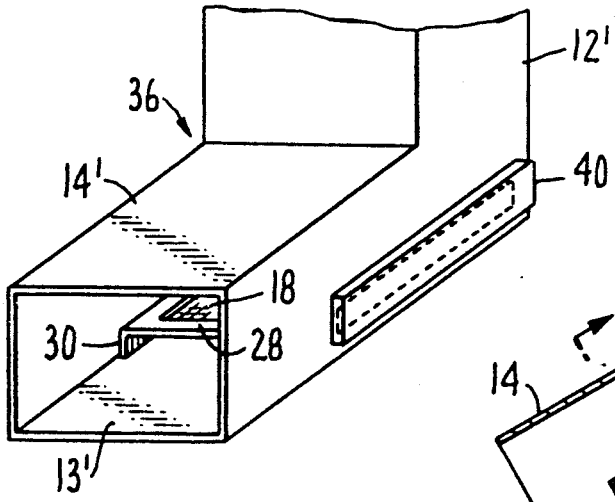
FIG. 8 is a perspective side view of the installed noise baffle shown in FIG. 7.

It should be observed that it is common in rain gutter systems to join a vertical downspout section to an angled downspout section with an "elbow" or other angled connector 36 having a short vertical portion and a short angled portion connected together at the desired angle as is shown in FIG. 6 or 8. The use of such elbow connectors permits rapid assembly of a gutterway system using straight sections of downspout pipe without having to form angles in the pipe on-site during construction of the gutterway system. Descriptions herein of the interior bottom surface of an angled downspout section are intended to include and be completely interchangeable with the interior bottom surface of an elbow-type connector.

The noise baffle shown in FIGS. 5–8 includes the same type of perforated or fibrous plate 18 described above. The spacer 30 along edge 26 is preferably of a fixed width of sufficient size to hold the top surface of the perforated or fibrous plate 18 a distance of preferably about one-half inch above the bottom surface 13' of angled downspout section 14' at the position where the falling water will strike perforated or fibrous plate 18. To permit installation of the noise baffle 16', the angled downspout section is modified as shown in FIG. 6 by cutting a narrow opening or slot 42 in the side of the downspout section 14' immediately beneath the vertical downspout section 12'. The distance between the bottom surface 13' and the slot 42 should be sufficient to permit the spacer 30 to rest on the bottom surface 13' of the angled downspout section 14' when the noise baffle is inserted. Preferably, this distance will permit the top surface of the perforated or fibrous plate 18 to be positioned about one-half inch above the bottom surface 13' of the angled downspout section 14'. The width of the slot 42 should also be sufficiently wide to permit the insertion of the noise baffle 16' and, particularly, the clearance of the spacer 30 and the inner lip 38 during insertion, and sufficiently narrow to permit the inner lip 38 and outer lip 40 to seal the opening when the noise baffle 16' is installed secured in position.

Outer lip 40, which is preferably attached to the top surface of edge 22, is used for sealing against the exterior of slot 42. Outer lip 40 can also be adapted as shown for manipulating the noise baffle during insertion and removal, or a handle or knob [not shown] can be added to ease installation and removal of the noise baffle. Outer lip 40 and inner lip 38 can be formed from the same material used to form the frame 20 or the edges 22, 24, 26, 28. Outer lip 40 and inner lip 38 can be further provided with a thin elastomeric gasket if desired to provide an additional seal against water leakage from slot 42.

Figure 9:
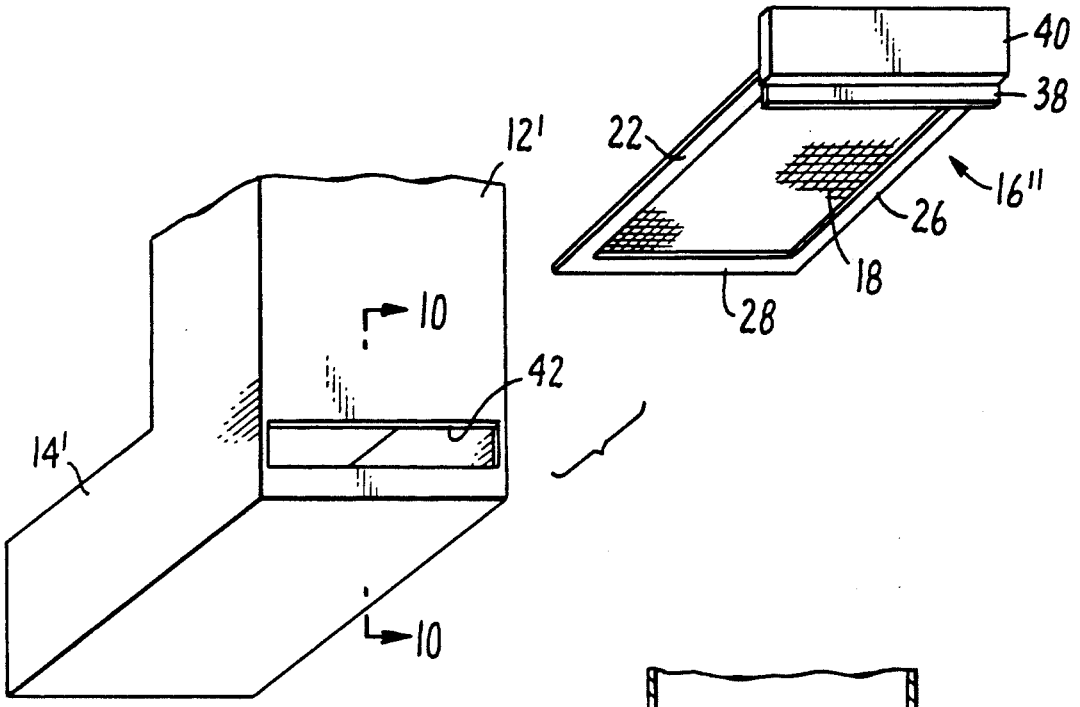
FIG. 9 is an exploded view of a typical junction between a vertical downspout section and an angled downspout section showing the placement of a noise baffle of the present invention.
Figure 10:
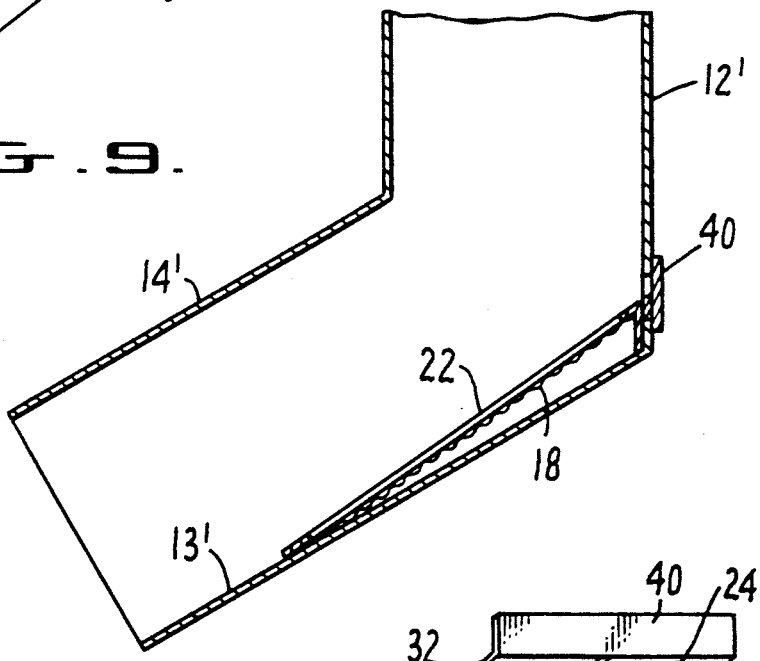
FIG. 10 is a sectional side view of an installed noise baffle taken through line 10—10 in FIG. 9.
Figure 11:
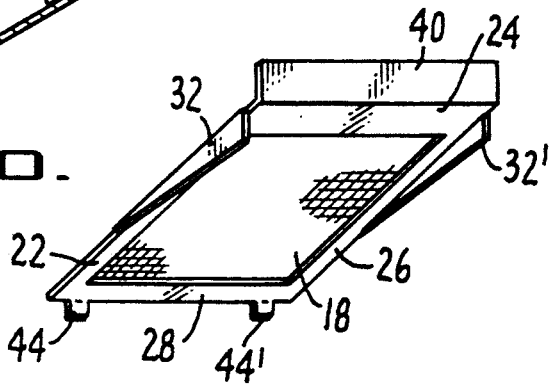
FIG. 11 is a top perspective view of a noise baffle adapted to be placed in the junction as shown if FIG. 9.

As shown in FIGS. 9 through 11, a noise baffle 16'' of the present invention can be constructed to be inserted into the back of a vertical downspout section 12' at a position close to the bottom surface 13' of the downstream adjoining angled downspout section 14'. Noise baffle 16'', as shown in FIG. 11, can be provided with legs 44, 44' at the junction of edges 28 and 22 and edges 28 and 26 respectively, for holding the top surface of noise baffle 16'' at a fixed or angled distance above the bottom 13 of angled downspout section 14. As noted above, such distance is preferably about one-half inch above the bottom surface 13' of angled downspout section 14' where the falling water contacts the top of perforated or fibrous surface 18. By using legs 44, 44', rather than a continuous strip spacer 30, as shown in the previous drawings, the flow of water out from under the noise baffle will not be obstructed. Alternatively, as shown in FIG. 9, legs 44, 44' can be omitted leaving no spacer along edge 28 at all. Noise baffle 16'' as shown in FIGS. 9–11 preferably includes a outer lip 40 attached to edge 24 for sealing against the exterior of slot 42 and for manipulating the noise baffle when inserting or removing, and a inner lip 38 for sealing against the interior of slot 42 and securing the noise baffle in position when the noise baffle is installed above the angled downspout section 14'.

As shown in FIGS. 9 and 10, to use this embodiment a slot or opening 42 having sufficient size to accomodate the noise baffle is provided in the back of the vertical downspout section 12' preferably less than about one-half inch above the bottom surface 13' of the adjoining downstream angled downspout section 14'. Thus, when noise baffle 16' is inserted, the spacing from the bottom surface 13' to the top surface of noise baffle 16' is provided by the spacing between the slot 42 and the bottom surface 13' of the angled downspout section 14'.

Figure 12:
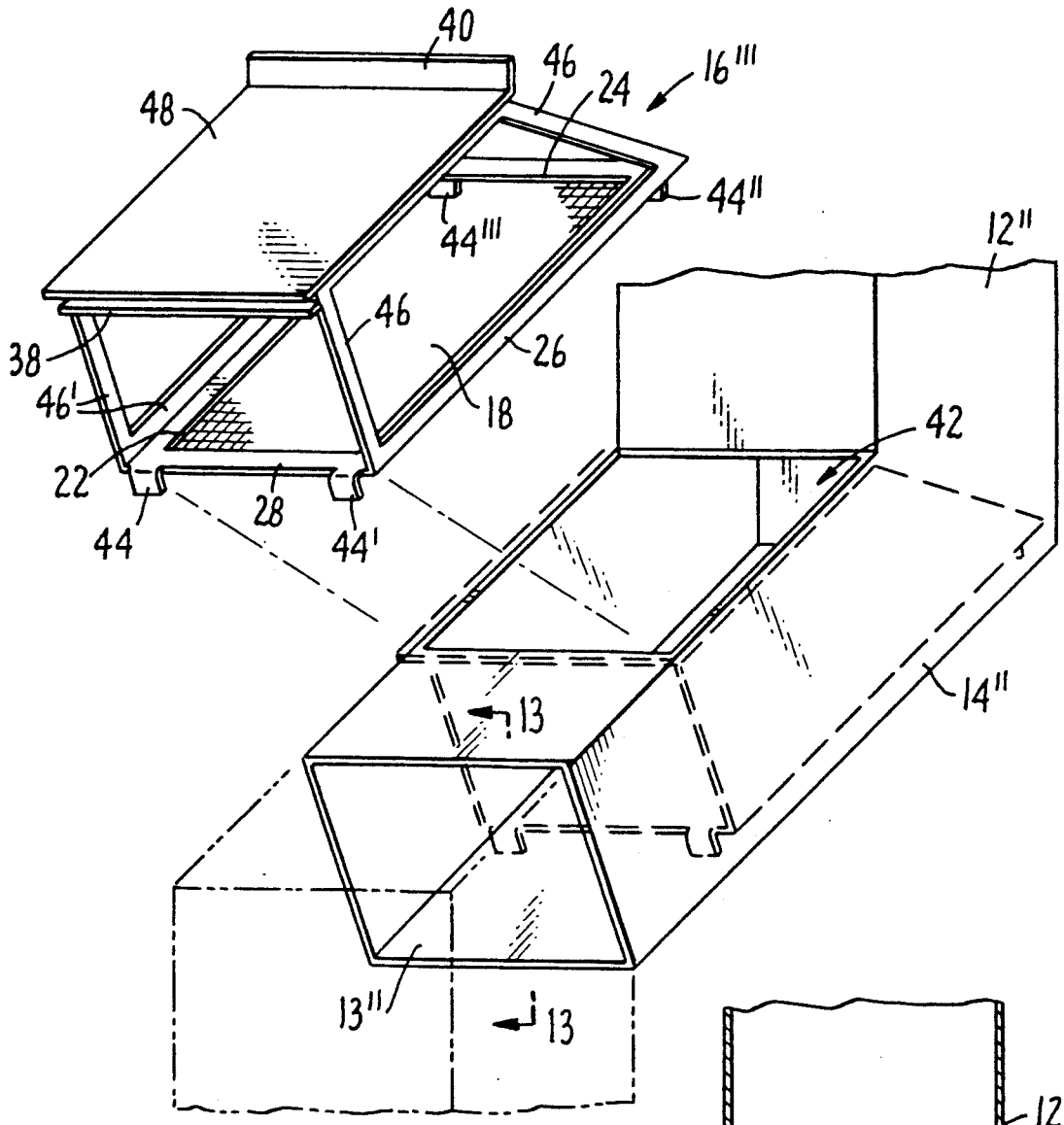
FIG. 12 is an exploded perspective front view of a junction between a vertical downspout section and an angled downspout section showing the placement of a noise baffle of the present invention.
Figure 13:
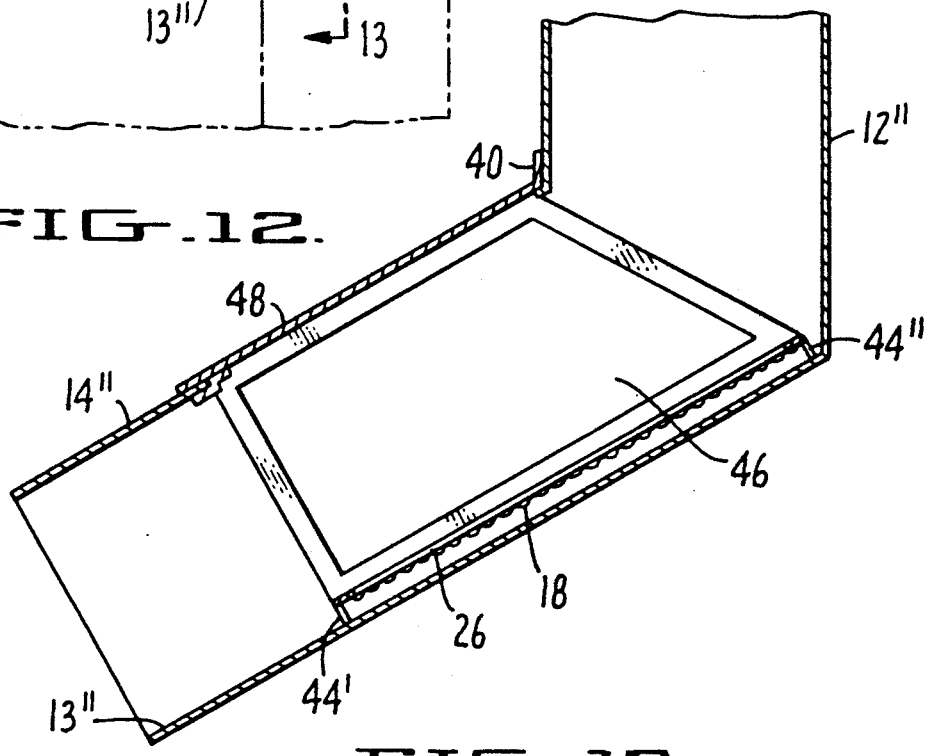
FIG. 13 is a sectional side view of an installed noise baffle taken through line 13—13 of FIG. 12.

As shown in FIGS. 12-13, an angled downspout section 14'' can be modified to permit a noise baffle 16''' of the present invention to be inserted from the top of an angled downspout section 14''. An opening 42 is provided in the top of angled downspout section 14'' of sufficient size to permit the insertion of noise baffle 16'''.

Noise baffle 16''' includes perforated or fibrous plate 18 and preferably includes frame 20. Legs 44, 44', 44'', 44''' are attached at the junctions between the edges to provide a means for positioning the top surface of the perforated or fibrous plate 18 a distance, of preferably about one-half inch, above the bottom surface 13'' of the angled downspout section 14'' so that any water falling through the vertical downspout section will strike the perforated or fibrous surface 18 of the noise baffle 16'''.

Lid 48 is provided for closing the opening 42 when noise baffle 16''' is installed. Lid 48 can be adapted to provide a lip 50 for overlapping the surface of angled downspout 14'' at the edges of opening 42. As shown in FIGS. 12-13, edge 24 of perforated or fibrous surface 18 extends beyond lid 48, and, thus, lid 48 is somewhat smaller than perforated surface 18. This permits edge 24 to extend up to the junction between the vertical downspout section 12'' and the angled downspout section 14'', completely covering the entire bottom surface 13'' of the angled downspout section 14''.

Inner lip 38 can be provided for sealing against the inside of the angled downspout section 14'' along the downstream edge of the opening 42 and for securing the noise baffle 16''' in position. Outer lip 40 can also be provided for sealing against the adjacent upstream vertical downspout section 12''. Outer lip 40 can be constructed to permit its use in manipulating the noise baffle 16''' during installation or removal, or, alternatively, a handle or other convenient manipulation device [not shown] can be provided on the outer surface of lid 48. Along edges 22 and 26 are preferably attached sides 46, 46' for spacing lid 48 away from perforated or fibrous plate 18. Sides 46, 46' are preferably of sufficient size to permit lid 48 to sit flush with the outer surface of angled downspout section 14'' when the noise baffle 16''' is in place. Alternatively, other spacing means such as legs connecting the lid 48 to the edges 22, 24, 26, 28 of the noise baffle 16''' of sufficient size to permit lid 48 to sit flush with the outer surface of angled downspout section 14'' when the noise baffle 16''' is in place may be used.

One skilled in the art will recognize that it would be possible to construct the elements of the present invention from a variety of materials and to modify the placement of the components in a variety of ways. For example, adhesive coated tape could be used to secure the noise baffle in place, rather than the clips and other structures described in detail above. While the preferred embodiments have been described in detail and shown in the accompanying drawings, it will be evident that various further modifications are possible without departing from the scope of the invention as embodied in the claims.

I claim:

1. A noise reduction device for a rain gutter system having a main horizontal gutter containing an opening therein, a downspout attached to said opening, said downspout having at least one vertical section and one angled section, said angled section having a bottom surface, and in which water is collected in the main gutter, flows through said opening into the vertical section, then falls through the vertical section onto the bottom surface of said angled section as it moves through said downspout, said device comprising:

means for baffling the noise caused by water falling through the vertical section of said downspout onto the surface of said angled section of said downspout;

means for removably securing said noise baffling means to and spacing said noise baffling means above the angled section of said downspout in said rain gutter system, said noise baffling means being secured to and spaced above the angled section of the downspout.

2. The noise reduction device of claim 1, wherein said securing means comprises at least one clip attached to an edge of the plate.

3. The noise reduction device of claim 1, wherein said securing means cooperates with a sealable opening cut into the downspout, said opening being adapted to permit the insertion and placement of said noise baffling plate substantially parallel to and above the bottom surface of said angled downspout section.

4. The noise reduction device of claim 1 in which said plate comprises a screen.

5. The noise reduction device of claim 4 in which said screen is from about 120 mesh to about 260 mesh in size.

6. The noise reduction device of claim 1 in which said means for spacing includes one or more spacers attached to the bottom of said plate.

7. The noise reduction device of claim 1 in which the top of said plate is located below the vertical downspout section, substantially parallel to and about one-half inch above the bottom surface of said angled downspout section.

8. The noise reduction device of claim 1, wherein said noise baffling means comprises a plate having a top, a bottom and at least one edge, said plate consisting essentially of a non-absorbent, rough, fibrous material of sufficient thickness for spacing the top of said plate between the vertical downspout section and the bottom surface of said angled downspout.

9. The noise reduction device of claim 9, wherein said securing means comprises at least one clip attached to an edge of the plate.

10. The noise reduction device of claim 8, adapted to cooperate with a sealable opening cut into the downspout, said opening being adapted to permit the insertion and placement of said noise baffling plate substantially parallel to and above the bottom surface of said angled downspout section.

11. A modified downspout section adapted to receive a noise baffle in a rain gutter system of the type having a main horizontal gutter containing an opening therein for attaching a downspout, said downspout section comprising:

at least one vertical portion and one angled portion, said angled portion having a bottom surface, and in which water flows from said vertical portion onto the bottom surface of said angled downspout portion; and, a sealable opening in said downspout section adapted for positioning a removable sound baffle between the vertical portion and the bottom surface of said angled portion, said removable sound baffle comprising a substantially flat perforated plate and a means for securing said plate in a position substantially parallel to and spaced above said bottom surface of said angled portion.

12. The modified downspout section of claim 11 in which said opening is in said vertical portion.

13. The modified downspout section of claim 11 in which said opening is in said angled portion.

14. The modified downspout section of claim 11 in which the angle between said vertical portion and said angled portion is from about 90 degrees to less than about 180 degrees.

15. A noise reduction device for a rain gutter system having a main horizontal gutter containing an opening therein, a downspout attached to said opening, said downspout having at least one vertical section and one angled section, said angled section having a bottom surface, and in which water is collected in the main gutter, flows through said opening into the vertical section, then falls through the vertical section onto the bottom surface of said angled section as it moves through said downspout, said device comprising:

a noise baffling plate, said plate having a top surface, a bottom surface, and at least one edge, said plate being generally flat and comprised of a porous material for reducing the velocity of the water falling through the vertical section before it strikes the bottom surface of the angled portion;

a means for removably securing the noise baffling plate in a position so that the bottom surface of the noise baffling plate faces the bottom surface of the angled section of the downspout, and the top surface of the noise baffling plate is spaced above the bottom surface of the angled section of the downspout.

16. The noise reduction device of claim 15 wherein the securing means comprises at least one clip attached to an edge of the plate.

17. The noise reduction device of claim 15 wherein said securing means cooperates with a sealable opening cut into the downspout, said sealable opening sized to permit the insertion of said noise baffling plate.

18. The noise reduction device of claim 15 in which said plate comprises a screen.

19. The noise reduction device of claim 18 in which said screen is from about 120 mesh to about 260 mesh in size.

20. The noise reduction device of claim 15 in which the top of said plate is located below the vertical downspout portion, substantially parallel to and about one-half inch above the bottom surface of said angled downspout section.

21. The noise reduction device of claim 15 wherein said plate comprises a non-absorbent, rough, fibrous material removably secured to the bottom surface of said angled downspout section, said fibrous material having a sufficient thickness for spacing the top of said plate above the bottom surface of said angled downspout section.

* * * * *